United States Patent [19]

Taylor

[11] 4,344,300

[45] Aug. 17, 1982

[54] CHILLERWELL COOLER

[76] Inventor: Frank Taylor, 9415 Central St., LaSalle, Quebec, Canada, H8R 2K4

[21] Appl. No.: 180,852

[22] Filed: Aug. 25, 1980

[51] Int. Cl.[3] ..... F25D 3/08

[52] U.S. Cl. ..... 62/457; 62/371; 62/529

[58] Field of Search ..... 62/457, 371, 372, 529, 62/530

[56] References Cited

U.S. PATENT DOCUMENTS 2,039,736 5/1936 Munters et al. ..... 62/530 X 3,605,435 9/1971 Taylor ..... 62/459

FOREIGN PATENT DOCUMENTS 511685 8/1939 United Kingdom ..... 62/457

*Primary Examiner*—Lloyd L. King

[57] ABSTRACT

A portable cooler enclosure comprising a hollow base member having thermal insulating properties and defined by a continuous side wall, a bottom wall and an open top end. A lid is engageable over the open top end and also has thermal insulating properties. A cooling container is disposable in the base member for cooling air therein. The cooling container has a continuous outer and inner side wall. An inner cooling well is defined intermediate the inner side wall for receiving one or more beverage containers therein. One or more cooling compartments are provided in the base member adjacent the outer wall of the cooling container.

12 Claims, 3 Drawing Figures

CHILLERWELL COOLER

BACKGROUND OF INVENTION (a) Field of Invention

The present invention relates to polyfoam coolers and more particularly to a portable cooler for transporting and cooling canned or bottled beverages.

(b) Description of Prior Art

There exists a variety of coolers on the market intended for the purpose of carrying canned or bottled beverages, some of which provide a cold pack as part of the package. These cold packs are supplied as soft packs or hard shell containers filled with the so-called "artificial ice", which is a very viscid, non-toxic chemical (carboxyl) having a lower freezing temperature than ordinary ice (25° F. or less).

The polyfoam coolers are generally box-shaped with body and lid, and such cold packs are intended to be placed upon pre-chilled beverages placed in the cooler. In other known designs, the cold pack is releasably attached to the cooler lid itself. Such an arrangement is moderately successful in keeping the beverages cool for a period of time. However, such arrangements are not successful in keeping the beverages cold for a prolonged period of time, such as eight hours or more, for the simple reason that the heat-absorption capability of the cold pack, in b.t.u.'s/hour, is invariably lower than the heat input to the cooler from the ambient air, in b.t.u.'s/hour, therefore the temperature of the beverages continues to rise from the outset, 2 degrees F. per hour being not uncommon. This deficiency, however, is not normally because the quantity of artificial ice provided is inadequate to the purpose, but rather the heat-absorption area of the cold pack is inadequate to the purpose. This fact is borne out by the observation that, in practically all cases of cooler use, it is found that there is still unmelted ice left in cold packs after the contents of such coolers have been consumed, and such contents (beverages) have been consumed at much higher temperatures than that at which they were when placed in the cooler.

One solution to the problem would seem to be the provision of larger, bigger quantity, cold packs to develop larger areas of heat absorption. This solution, however, would result in higher costs and even more ice being unused at the end of the consumption period.

A much more practical and desirable solution resides in the re-design of the cold pack to more fully develop its heat absorption capability to such an extent that the beverages in the cooler may be chilled to their initial temperature at any time and over a prolonged period of time, such as 24 hours.

SUMMARY OF INVENTION

It is a feature of the present invention to provide the cooler design which accomplishes the above-mentioned desired solution.

A further feature of the present invention is to provide a cooler enclosure having a specific design for the storage of beverage containers therein, and in a predetermined manner, whereby the performance of the cooling effect of the cooler enclosure is predetermined.

A further feature of the present invention is to provide a portable cooler enclosure having a base member and a lid and permitting the precise location of an annular cooling container which defines an inner cooling well to receive a beverage container therein for rapid cooling of the beverage container.

According to the above features, from a broad aspect, the present invention provides a portable cooler enclosure comprising a hollow base member having thermal insulating properties and defined by a continuous side wall, a bottom wall and an open top end. A lid is engageable over the open top end and also has thermal insulating properties. A cooling container is disposable in the base member for cooling air therein. The cooling container has a continuous outer and inner side wall. An inner cooling well is defined intermediate the inner side wall for receiving one or more beverage containers therein. One or more cooling compartments are provided in the base member adjacent the outer wall of the cooling container.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
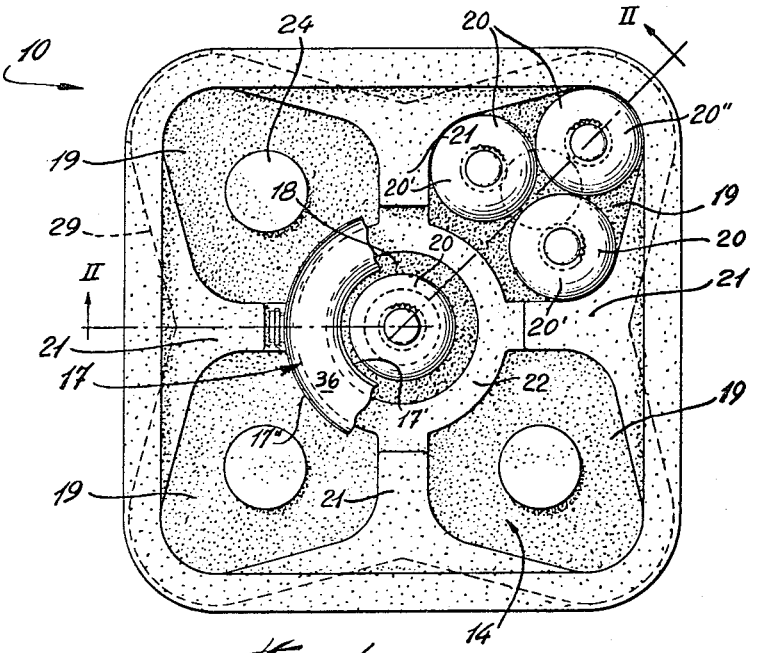
FIG. 1 is a top view of the cooler base member showing the cooling container partly fragmented.

Referring now to the drawings, there is shown generally at 10 a portable cooler enclosure of the present invention. The enclosure comprises a hollow base member 11 defined by a continuous side wall 12, a bottom wall 13, and an open end 14. A lid 15 is engageable over the open top end in seating abutment on a flat top circumferential face 16 of the continuous side wall 12. A cooling container 17 is disposable in the base member 11 for cooling the air in the base member.

The cooling container 17 or so-called cold pack is constructed of blow-molded high density polyethylene, generally in the shape of a large donut and defines an inner side wall 17' and outer side wall 17" concentrically spaced. The container 17 has a capacity of 36 ozs. of coolant (artificial ice) and an overall diameter of 6" and a height of 4". A 3" hole, constituting an inner cooling well 18, is molded in the center of the cold pack. This cold pack 17, in conjunction with the design and shape of the cooler base and lid, provides not only an increase in the total heat-absorption surface when compared with conventional design cold packs of similar capacity, but additionally, provides cooling power to outer cooling compartments 19 in the cooler adjacent its outer peripheral wall 17" while providing completely independent concentrated cooling power to a small inner cooling well 18 surrounded by the inner wall 17' of the cold pack 17 and portions of the cooler body and lid, as described later.

The cooler 10 is not merely a box shape with lid but a structured shape, generally square with rounded corners, comprising a base member 11 and lid 15. The base member 11 of the cooler has five compartments, one of which is centrally located and provides a receptacle for the cold pack 17, while the other four compartments 19 are designed to contain three canned or bottled beverage containers 20 each standing upright.

The four compartments 19 are arranged at 90° angles about the central compartment and in open communication with the cooling container 17 in the central compartment. Four upstanding ribs 21, evenly spaced about the cooler, project inwardly from the inner surface of the side wall 12 of the base member 11 to define the four corner compartments 19 and form a positioning means or abutment for the cold pack 17. An annular rib 22 is molded integrally with the cooler body base 13 and projects upwardly from the cooler base to support the cold pack 17 and define the lower portion of the central compartment, while the cooler lid 15 has a matching downwardly-extending annular top rib 23 molded integrally with the cooler lid 15 to define the upper portion of the cooling well 18. This upper annular rib 23 and lower annular rib 22 work in conjunction with the inner wall 17' of the cold pack 17 providing a completely separate and substantially air tight inner chamber 18 whose function will be described later.

At the base of each of the four outer compartments 19 at mid-location is an integrally molded pedestal 24 upon which the beverage containers 20 rest and which provide an air space below the containers 20 for convection air to pass.

When the cooler is charged with 12 chilled beverage containers 20 (cans or bottles), the frozen cold pack 17 in position and the lid 15 applied, the outer side wall 17'' of the cold pack provides cooling power to each of the outer compartments 19 independently due to the abutment of the outer side wall 17'' of the cold pack to each of the dividing ribs 21, so that when the contents of one of the compartments 19 has been evacuated, the cooling power of the cold pack to adjacent compartments is not affected. Similarly, for example, if one of the outer compartments 19 has been filled with, say, cheese and crackers, instead of cold beverages, the cooling power to the other compartments is not affected.

It will be noted that the inner two containers 20' of each of the four compartments 19 are on a common circle with respect to the center of the cooler and are in contact with the cold pack outer side wall 17'', while the outer four containers 20'' at the corners of the cooler are remote from the cold pack 17 in addition to being partly surrounded by a larger heat-absorbing wall area of the cooler base member, meaning that these four containers 20'' will not keep as cool as the inner eight containers 20' (generally 3 or 4 degrees higher).

Since ice in any form of container will melt from the outside exposed surface inwardly, it will be seen that the proposed design of cold pack 17 will commence melting from its outer surface adjacent the four outer compartments 19 at a rate commensurate with the heat input to these compartments from the ambient air through the cooler side wall, lid and bottom wall, and these combined factors will determine the temperature inside these compartments at any given time. With respect to the central inner cooling well 18, however, the heat input from the ambient air is minimal since it can only enter such inner chamber through small areas at the top (lid) and bottom wall portion of the cooler, since in the rest of the area, the peripheral walls are defined by the cold pack inner side wall 17'. It will be obvious, therefore, that this inner cooling well chamber will control at a much lower temperature than each of the outer four chambers 19. In effect, therefore, in this application, the cold pack 17 is servicing a total of five cooling compartments, one each to the four outer compartments 19 from its outer side wall and an additional one to the inner cooling well chamber from its inner side wall.

It will be apparent, therefore, that what this cooler provides which no other provides, is a two-stage cooler, primary cooling in the outer four compartments 19 to each of the 12 beverage containers 20 and secondary cooling at a much lower temperature to any one of such containers 20 on a progressive basis, or as desired.

The cooler also makes provision for the carrying of two 13-oz. plastic cups, shown in phantom lines at 30, which are carried in the central compartment 18 during transportation of the cooler to the picnic site, etc.

In actual use, the cooler is employed as follows: 12 canned or bottled beverages 20 taken from the refrigerator and a temperature of about 40° F. are placed in the cooler base member 11 along with the pre-frozen cold pack 17 and plastic cups 30. At the picnic site, campground, fishing hole, etc., the lid 15 is removed from the cooler base member 11, the plastic cups 30 removed and one of the outer beverage containers 20 is placed in the inner cooling well chamber 18, preferably one of the outer four beverage containers 20'', since these will be at a slightly higher temperature as previously explained. When a cold beverage container is desired, the one in the central well is taken and replaced with one of the others and the cooler re-covered. This procedure is followed on a progressive basis throughout the consumption of the contents of the cooler and will ensure always obtaining a cold drink at the coolest possible temperature.

Figure 3:
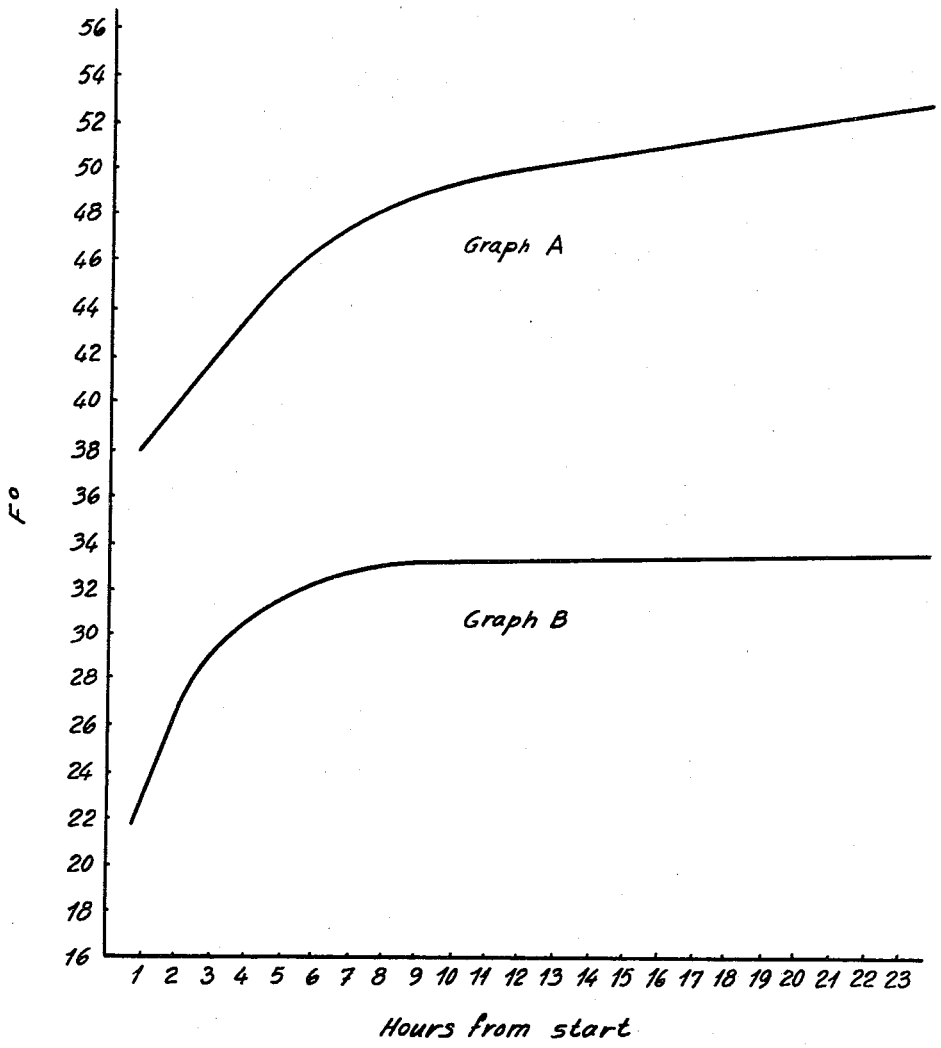
FIG. 3 is a graph illustration showing the beverage temperature in the outer compartments, and air temperature in the cooling well compartment.

In order to test the efficacy of the cooler design, a model was constructed according to the design illustrated in the drawings with the cooler base member 11 and lid 15 made from ¾" thick polyfoam and the cold pack 17 filled with 36 ozs. of artificial ice (blue gel). Twelve cans of beer chilled to 38° F. in the refrigerator were placed in the cooler compartments 19 and the lid 15 applied. Since the test results were taken over a 24-hour period, day and night, the ambient air temperature varied between 70°–80° F. The test results were as shown on the graphs illustrated in FIG. 3.

It will be seen that curve "A" represents the actual beer temperature taken on an hourly basis over the 24-hour period, while curve "B" represents the air temperature at the mid-point in the central cooling well chamber 18. The inner 8 cans 20' of beer had an average rise in temperature of 1° F. per hour over the initial 12-hour period and then more or less stabilized over the succeeding 12 hours. The corner four cans 20'' were about 4 degrees higher, on the average, for reasons previously explained. The temperatures in the central cooling well chamber 18, as shown on curve "B", reached a stabilizing temperature in much quicker time, as shown, such stabilizing temperature, on the average, being only a degree or two above freezing temperature (32° F.). Since normal refrigerator temperature is about 38°–40° F., it will readily be seen that the central cooling well chamber has considerably more chilling power, even after a 24-hour period, at which time the ice is practically all consumed. As a practical expression of this chilling power, a single container taken out of an outer compartment after 5 hours into the test and having a temperature of 46° F. and placed into the central well, was reduced in temperature to 39° F. in just 13 minutes. It will be appreciated that if the central cooling well is utilized from the commencement of the consumption on a rotational basis, as previously suggested, optimum results will obtain. When it is recognized that not everyone likes beverages as cold as 40° F. or so, especially beer, the design may alternatively provide a wide range of temperature choices. For example, if the outer 4 containers 20'' are not placed in the central cooling well, they may be consumed at temperatures in the 45°–55° F. range. The inner 8 containers 20' may be consumed in the 40°–50° F. range. If any of the containers are placed in the central cooling well and left for a sufficient time, they may be consumed a degree or two above freezing.

As previously described, the cooler and consequently the base member is of a square configuration and the side wall 12 is defined by four side walls. A depression 29 is formed at each of the side walls towards the center of the side walls and below a marginal top ridge portion 28 of the base member whereby to provide hand grips 27 in each of the four side walls. This eliminates extra costs and any enlargement of the cooler size for the provision of handles for carrying the cooler.

As previously described, the lid and the cooler base member are constructed of polyfoam material. An excellent seal is provided between the base member and the lid by the provision of an inner sealing ridge 31 depending from an inner face 32 of the lid 15 adjacent an outer edge thereof. This sealing ridge 31 provides a frictional fit with an outer inside marginal edge portion 33 of an inner face of the base member side wall 12. A peripheral support ridge 34 is disposed along the outer edge of the lid and spaced from the inner sealing ridge 31 for seating abutment on the flat top circumferential face 16 of the continuous side wall 12 to provide a further marginal seal for the lid. An air space 35 separates the sealing ridge 31 from the support ridge 34.

Figure 2:
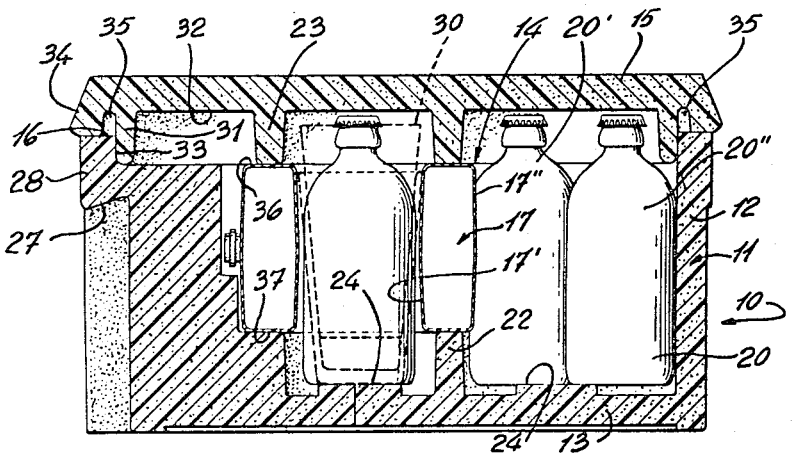
FIG. 2 is a section view along section lines 2—2 of FIG. 1 and showing the position of beverage containers supported in the cooler enclosure.

As can be seen more clearly in FIG. 2, the annular top rib 23 which depends from the cover inner face 32 abuts a flat top wall 36 of the cooling container 17 whilst the bottom flat wall 37 of the container 17 sits onto the top face of the annular bottom ridge 22. A pedestal 24 is also provided from the bottom wall of the base member and projects into the inner cooling well chamber 18.

It is within the ambit of the present invention to cover any obvious modifications of the embodiment described herein, provided such modifications fall within the scope of the appended claims.

I claim:

1. A cooler enclosure comprising a hollow base member having thermal insulating properties and defined by a continuous side wall, a bottom wall and an open top end; a lid engageable over said open top end and also having thermal insulating properties, a cooling container disposable in said base member for cooling air therein, said cooling container having a continuous outer and inner side wall, an inner cooling well intermediate said inner side wall for receiving one or more beverage containers therein, and one or more outer cooling compartments in said base member adjacent said outer wall of said cooling container.

2. A cooler as claimed in claim 1 wherein said cooling container is an annular container, said inner and outer side walls being concentrically spaced from one another, said inner cooling well receiving a single beverage container therein, said cooling container being captive between said base member and said lid.

3. A cooler as claimed in claim 2 wherein an annular bottom ridge is provided centrally of said base member bottom wall and formed integral therewith to form a bottom portion of said cooling well and to support a base wall of said cooling container thereon above said bottom wall, an annular top rib formed with said lid and extending outwardly of an inner face thereof to form a top portion of said cooling well, said annular top rib abutting a top wall of said cooling container when said lid is engaged over said open end, and means to maintain said cooling container in position centered over said annular bottom rib.

4. A cooler as claimed in claim 3 wherein said annular bottom and top portions of said cooling well and said inner side wall of said annular cooling well define a substantially air-tight inner cooling well chamber.

5. A cooler as claimed in claim 3 wherein said means to maintain said cooling container in position over said annular bottom rib comprises a plurality of inwardly projecting ribs extending inwardly in said base member and extending from an inner face of said continuous side wall and bottom wall thereof.

6. A cooler as claimed in claim 5 wherein said outer cooling compartments adjacent said outer wall of said cooling container are defined by the space intermediate adjacent ones of said inwardly projecting ribs.

7. A cooler as claimed in claim 2 wherein said one or more outer cooling compartments adjacent said outer wall of said cooling container comprises four compartments disposed side-by-side about a central annular bottom ridge formed in said base member bottom wall, said four compartments being separated from one another by a partition rib wall projecting from said base member bottom wall and an inner face of said continuous side wall.

8. A cooler as claimed in claim 7 wherein each said four compartments are configured to accommodate three beverage containers having cylindrical bodies, two of said containers being disposable substantially equidistantly spaced from said cooling container in close proximity thereof and lying on an arc of a circle having a common center with said inner cooling well.

9. A cooler as claimed in claim 8 wherein each said four compartments is of substantially triangular shape in planar configuration and wherein a third of said beverage containers is disposable adjacent an apex portion of said compartment to a common side of said two of said containers further away from said cooling container.

10. A cooler as claimed in claim 9 wherein a pedestal projects inwardly and centrally from a bottom wall of each said four compartments to support said beverage containers disposed therein elevated from said bottom wall, a further central pedestal projecting inwardly and centrally from the bottom wall of said inner cooling well to support a beverage container disposed therein elevated from its bottom wall.

11. A cooler as claimed in claim 1 wherein said base member is of a square configuration and having four side walls, and a depression in each side wall below a marginal top ridge portion thereof to provide hand grips.

12. A cooler as claimed in claim 1 wherein said lid is constructed of flexible foam material, an inner sealing ridge depending from an inner face of said lid adjacent an outer edge thereof for frictional fit with an inside marginal edge portion of an inner face of said base member continuous side wall, and a peripheral support ridge disposed along said outer edge of said lid and spaced from said inner sealing ridge for seating abutment on a flat top circumferential face of said continuous side wall to provide a further marginal seal for said lid.

* * * * *